US006568104B2

(12) United States Patent
Liu

(10) Patent No.: US 6,568,104 B2
(45) Date of Patent: May 27, 2003

(54) EASY-TO-WEAR SHOE

(76) Inventor: Kun-Chung Liu, No. 5, Alley 9, Lane 212, San-Feng Rd., Hou-Li Hsiang, Taichung Hsien (TW)

( * ) Notice: Subject to any disclaimer, the term of this patent is extended or adjusted under 35 U.S.C. 154(b) by 0 days.

(21) Appl. No.: 09/941,346

(22) Filed: Aug. 28, 2001

(65) Prior Publication Data

US 2003/0041476 A1 Mar. 6, 2003

(51) Int. Cl.[7] ..... A43C 11/00

(52) U.S. Cl. ..... 36/50.1; 24/712; 24/712.4; 24/713

(58) Field of Search ..... 36/50.1, 50.5, 36/54; 24/712, 712.1–712.9, 713, 713.1–713.9

(56) References Cited

U.S. PATENT DOCUMENTS 2,266,083 A * 12/1941 Rzepa ..... 24/712.4
3,279,015 A * 10/1966 Henning ..... 24/712.2
4,282,657 A * 8/1981 Antonious ..... 36/50.1
4,414,761 A 11/1983 Mahood
4,628,622 A * 12/1986 McBarron ..... 36/50.1
5,353,483 A * 10/1994 Louviere ..... 24/712.1
5,357,691 A * 10/1994 Hyde et al. ..... 36/54
5,469,640 A 11/1995 Nichols
5,907,912 A * 6/1999 Alaimo ..... 36/50.1

FOREIGN PATENT DOCUMENTS

DE 4024782 A * 6/1991 ..... A43C/1/06

* cited by examiner

*Primary Examiner*—Mickey Yu
*Assistant Examiner*—Jila M. Mohandesi
(74) *Attorney, Agent, or Firm*—Knobbe Martens Olson & Bear LLP

(57) ABSTRACT

A shoe body includes first and second eyelet tabs. The second eyelet tab includes a front portion proximate to a vamp, a rear portion proximate to a top shoe opening, and an intermediate eyelet-free portion therebetween. Each of the front and rear portions of the second eyelet tab is provided with at least one eyelet. A first fastener has a mounting section mounted securely on the intermediate eyelet-free portion of the second eyelet tab, and a fastener engaging section provided on the mounting section. A second fastener has a shoe lace stringing section formed with at least one eyelet, and a fastener engaging section extending from the shoe lace stringing section and capable of removable engagement with the fastener engaging section of the first fastener. A shoe lace unit is strung through the eyelets of the first and second eyelet tabs and the second fastener.

5 Claims, 11 Drawing Sheets

EASY-TO-WEAR SHOE

BACKGROUND OF THE INVENTION

1. Field of the Invention

The invention relates to a shoe, more particularly to a shoe which is easy to wear and remove.

2. Description of the Related Art

A conventional shoe usually includes a shoe body with a top opening, and a shoe lace. The shoe body includes a vamp, a tongue, and a pair of eyelet tabs. The tongue has a front portion connected to the vamp, and a rear portion extending to the top opening. The tongue further has an opposite pair of lateral sides that extend from the vamp to the top opening. Each of the eyelet tabs is connected to the vamp, and is disposed adjacent to one of the lateral sides of the tongue. Each of the eyelet tabs is formed with a plurality of eyelets that are aligned with each other in a direction from the vamp to the top opening. The shoe lace has a front portion, and a rear portion. The front portion of the shoe lace is strung through the eyelets to form a criss-cross pattern on the eyelet tabs. The rear portion of the shoe lace can be tied together so as to tighten the shoe. However, it is time-wasting to tie and untie the shoe lace when wearing and removing the shoe.

U.S. Pat. No. 5,469,640 discloses a quick adjusting shoe lace system for adjusting shoe lace tension in a single movement. Referring to FIGS. 1 and 2, the shoe lace system disclosed in this U.S. patent includes a cinch plate 3 having eyelets 301 which are spaced apart by about the same distance as eyelets 201 formed in the eyelet tabs of the shoe. The shoe lace 1 is strung through the eyelets 301 at the cinch plate 3 along with the eyelets 201 in the eyelet tabs of the shoe. A strap 4, fixably attached at a lower end to the shoe body 2 and loopable at an upper end through a slot in the cinch plate 3, is used to adjustably pull the cinch plate 3 and the shoe lace 1 looped through the eyelets 301 downwardly and thus increase the shoe lace tension so as to tighten the shoe. However, the shoe lace system disclosed in this U.S. patent is merely configured to adjust tension of the shoe lace, and does not facilitate wearing and removal of the shoe.

U.S. Pat. No. 4,414,761 discloses a shoe having an improved closure. Referring to FIGS. 3 and 4, the closure of the shoe 6 disclosed in this U.S. patent includes a first elongate area 601 provided with a plurality of eyelets, a second non-apertured elongate area 602 provided with a male VELCRO™ fastener 702, a shoe lace 5, and a panel 7 provided with a plurality of eyelets corresponding to the eyelets of the first elongate area 601 and a female VELCRO™ faster 701 on the inner surface of the panel 7. The shoe lace 5 is strung through the eyelets of the first elongate area 601 and the eyelets of the panel 7 to form a criss-cross pattern. The panel 7 can releasably engage the second non-apertured elongate area 602 through the engagement between the male and female fasteners 702, 701.

Although the shoe disclosed in U.S. Pat. No. 4,414,761 facilitates wearing and removal of the shoe, the VELCRO™ fasteners are liable to loosen during use and easily accumulate dirt thereon.

SUMMARY OF THE INVENTION

Therefore, the object of the present invention is to provide a shoe which is easy to wear and remove and which has fasteners that can minimize undesired loosening.

The shoe according to this invention includes a shoe body, a first fastener, a second fastener, and a shoe lace unit.

The shoe body has a top opening, and includes a vamp, a tongue, a first eyelet tab and a second eyelet tab. The tongue has a front portion connected to the vamp, and a rear portion extending to the top opening. The tongue further has an-opposite pair of lateral sides that extend from the vamp to the top opening. The first and second eyelet tabs are connected to the vamp, and are respectively disposed adjacent to the lateral sides of the tongue. The first eyelet tab is formed with a plurality of eyelets. The second eyelet tab includes a front portion proximate to the vamp, a rear portion proximate to the top opening, and an intermediate eyelet-free portion between the front and rear portions of the second eyelet tab. Each of the front and rear portions of the second eyelet tab is provided with at least one eyelet.

The first fastener has a mounting section mounted securely on the intermediate eyelet-free portion of the second eyelet tab, and a fastener engaging section provided on the mounting section.

The second fastener has a shoe lace stringing section formed with at least one eyelet, and a fastener engaging section extending from the shoe lace stringing section and capable of removable engagement with the fastener engaging section of the first fastener.

The shoe lace unit has a first portion and a second portion. The first portion of the shoe lace unit is strung through the eyelets of the first eyelet tab, the eyelets of the second eyelet tab and the eyelet of the shoe lace stringing section of the second fastener to form a criss-cross pattern on the first and second eyelet tabs. The second portion of the shoe lace unit is disposed proximate to the top opening.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 7:
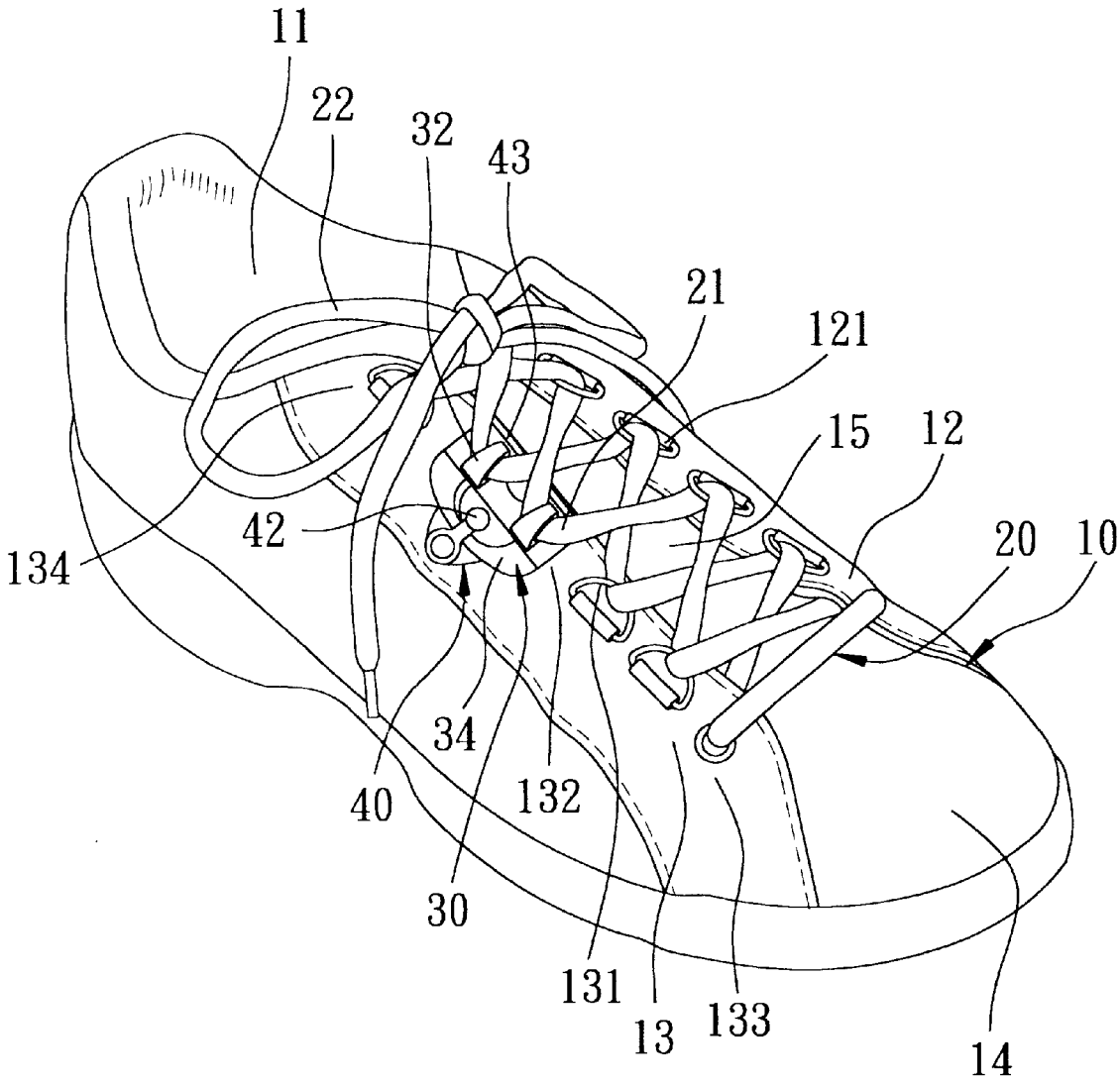
FIG. 7 is a perspective view of the first preferred embodiment of the shoe according to this invention.

Referring to FIG. 7, the shoe according to this invention includes a shoe body 10, a first fastener 40, a second fastener 30, and a shoe lace unit 20.

The shoe body 10 has a top opening 11 and includes a vamp 14, a tongue 15, a first eyelet tab 12 and a second eyelet tab 13. The tongue 15 has a front portion connected to the vamp 14, and a rear portion extending to the top opening 11. The tongue 15 further has an opposite pair of lateral sides that extend from the vamp 14 to the top opening 11. The first and second eyelet tabs 12, 13 are connected to the vamp 14, and are respectively disposed adjacent to the lateral sides of the tongue 15. The first eyelet tab 12 is formed with a plurality of eyelets 121 that are aligned with each other in a direction from the front portion of the tongue 15 to the top opening 11. The second eyelet tab 13 includes a front portion 133 proximate to the vamp 14, a rear portion 134 proximate to the top opening 11, and an intermediate eyelet free portion 132 between the front and rear portions 133, 134 of the second eyelet tab 13. The front portion 133 of the second eyelet tab 13 is provided with three eyelets 131. The rear portion 134 of the second eyelet tab 13 is provided with a single eyelet 131. The eyelets 131 in the second eyelet tab 13 are aligned with each other in a direction from the front portion of the tongue 15 to the top opening 11. The intermediate eyelet-free portion 132 of the second eyelet tab 13 is located to correspond to two of the eyelets 121 of the first eyelet tab 12.

Figure 1:
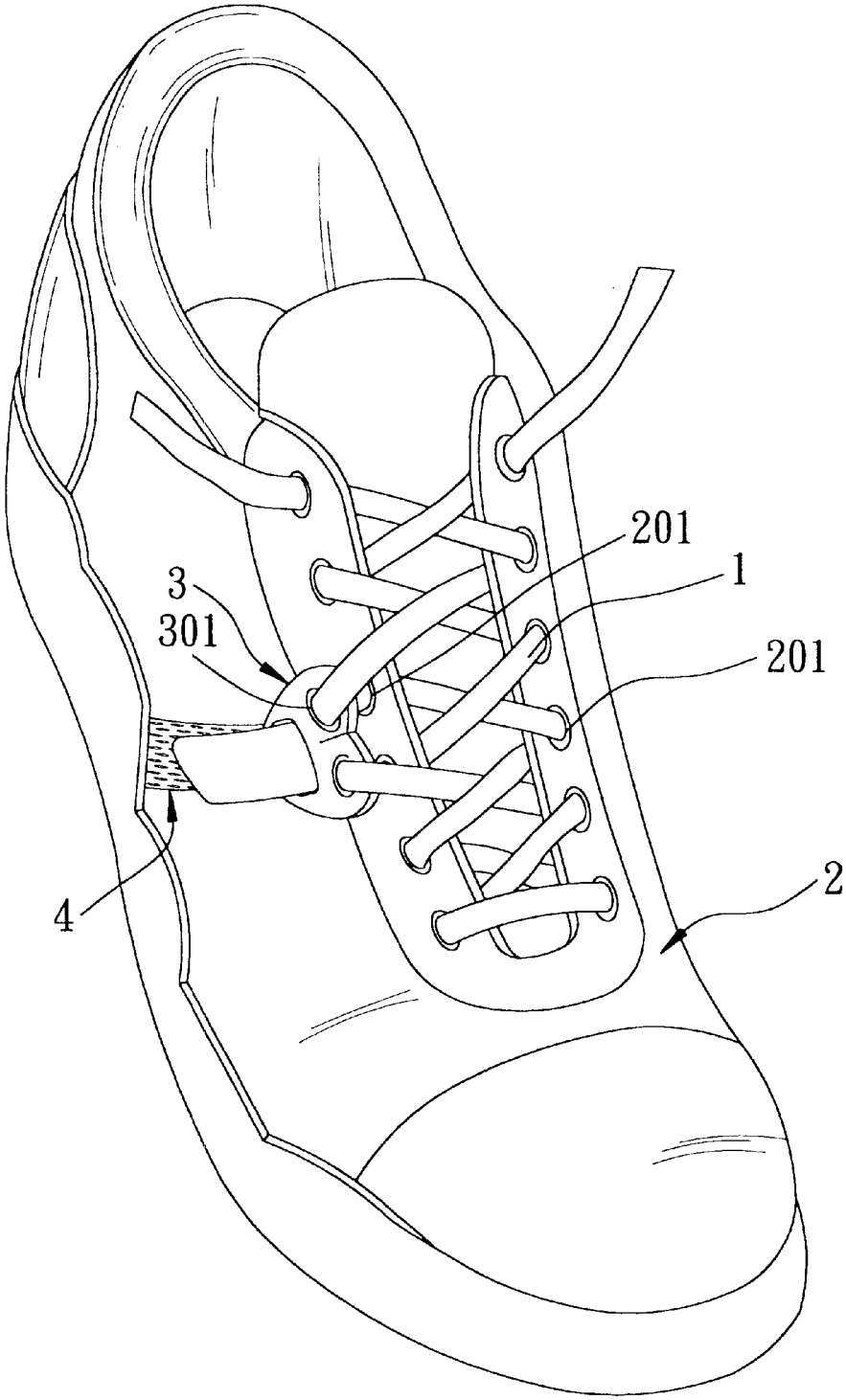
FIG. 1 PRIOR ART
FIG. 1 is a perspective view of a conventional shoe disclosed in U.S. Pat. No. 5,469,640.
Figure 2:
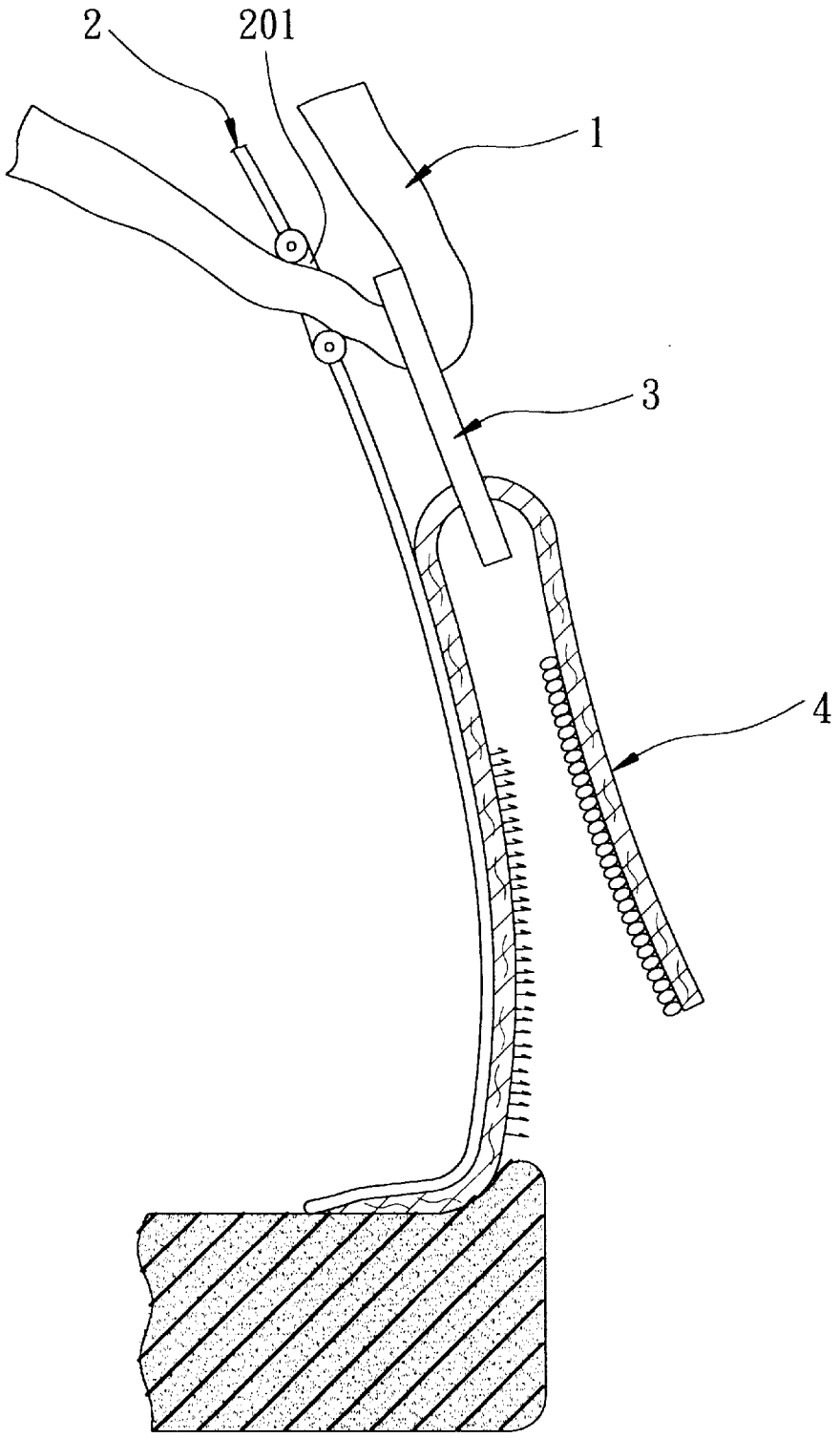
FIG. 2 PRIOR ART
FIG. 2 is a fragmentary sectional view of the shoe of FIG. 1.
Figure 3:
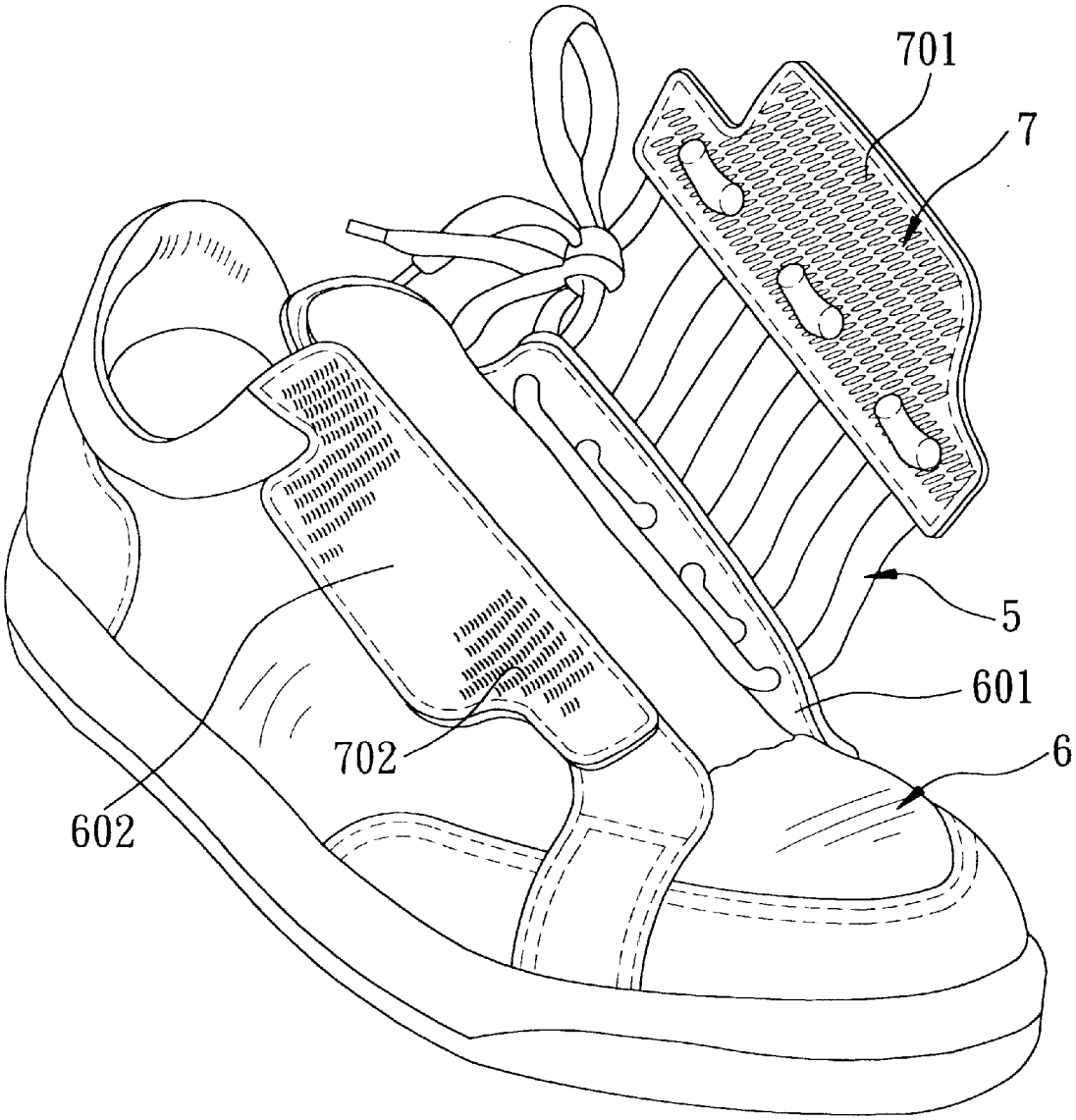
FIG. 3 PRIOR ART
FIG. 3 is a perspective view of another conventional shoe disclosed in U.S. Pat. No. 4,414,761 in an opened state.
Figure 4:
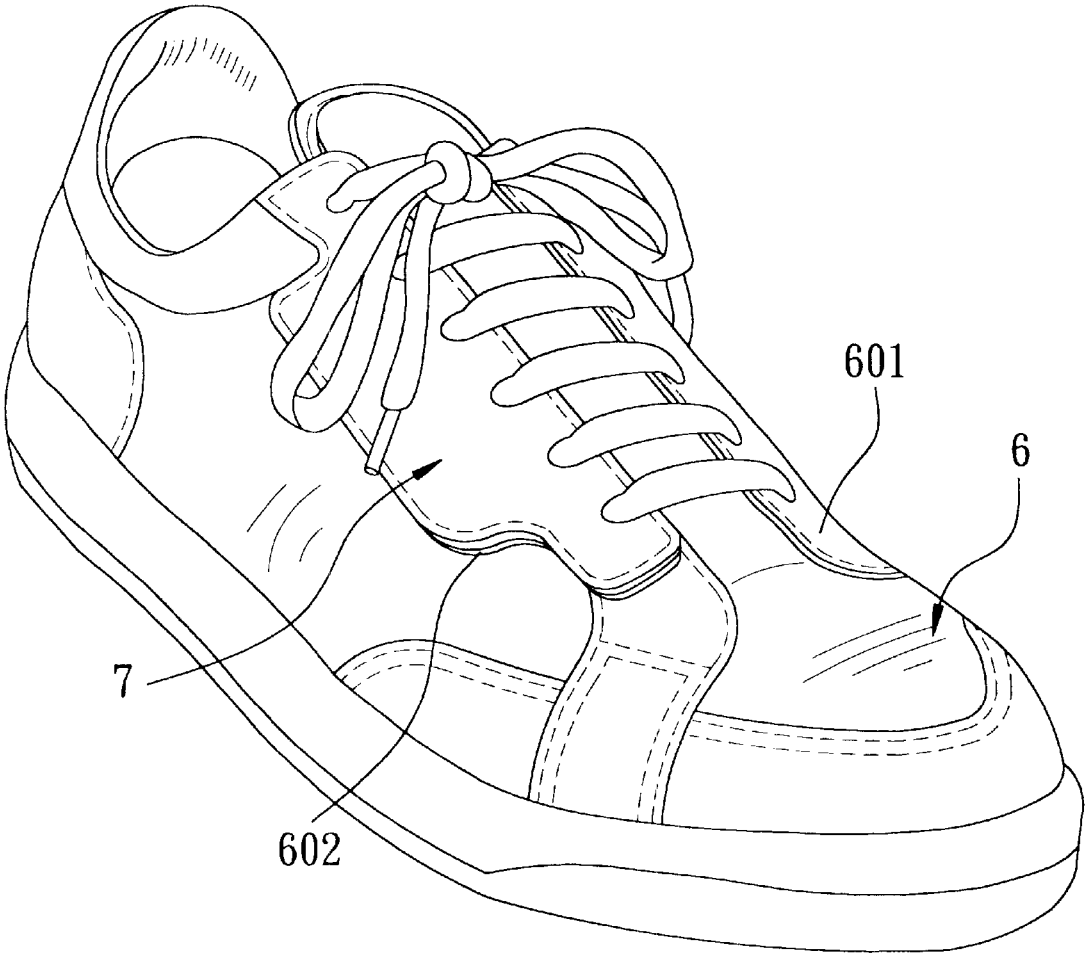
FIG. 4 PRIOR ART
FIG. 4 is a perspective view of the shoe of FIG. 3 in a closed state.
Figure 5:
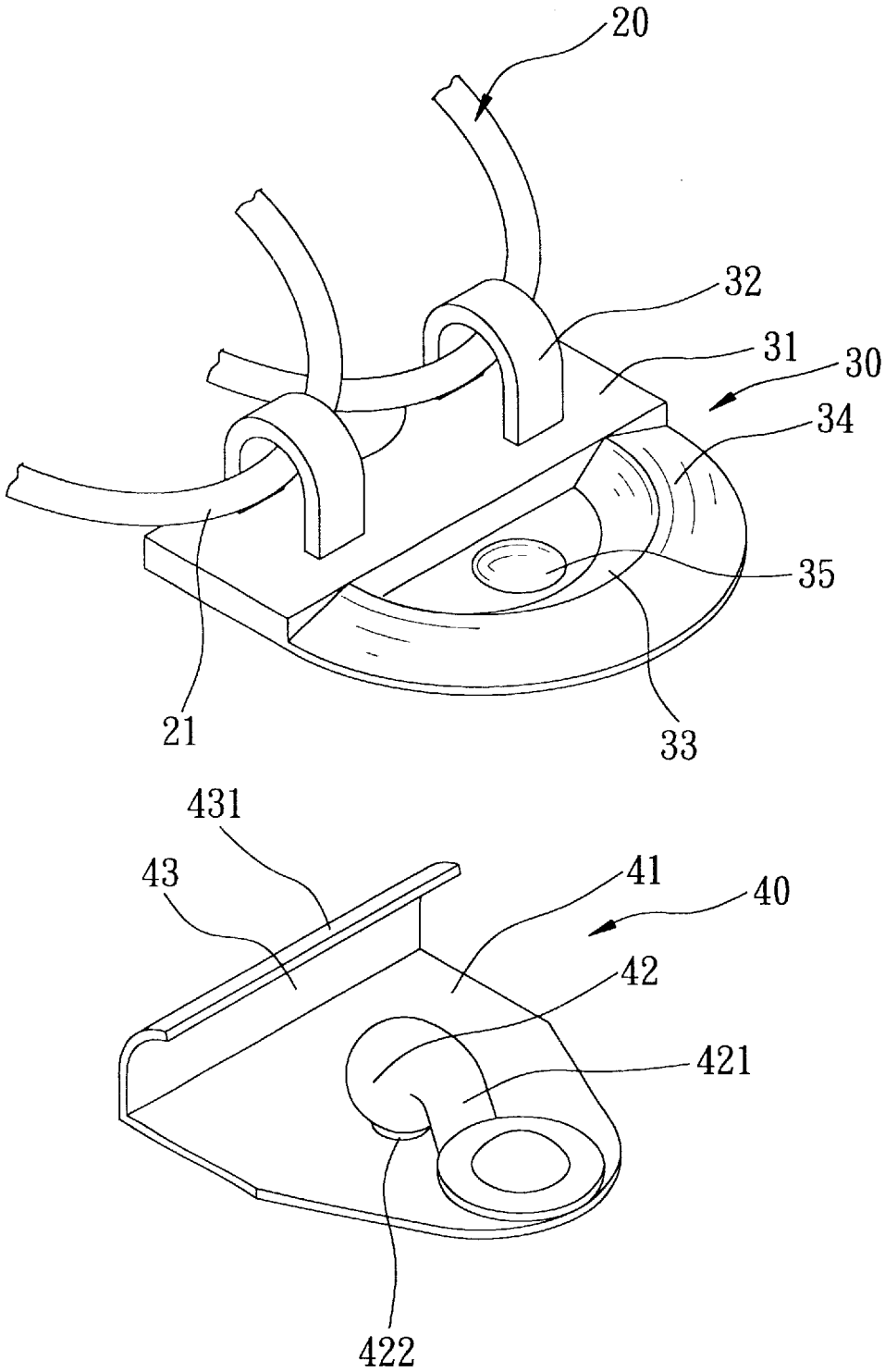
FIG. 5 is a perspective view showing a first fastener and a second fastener of the first preferred embodiment of a shoe according to this invention.
Figure 6:
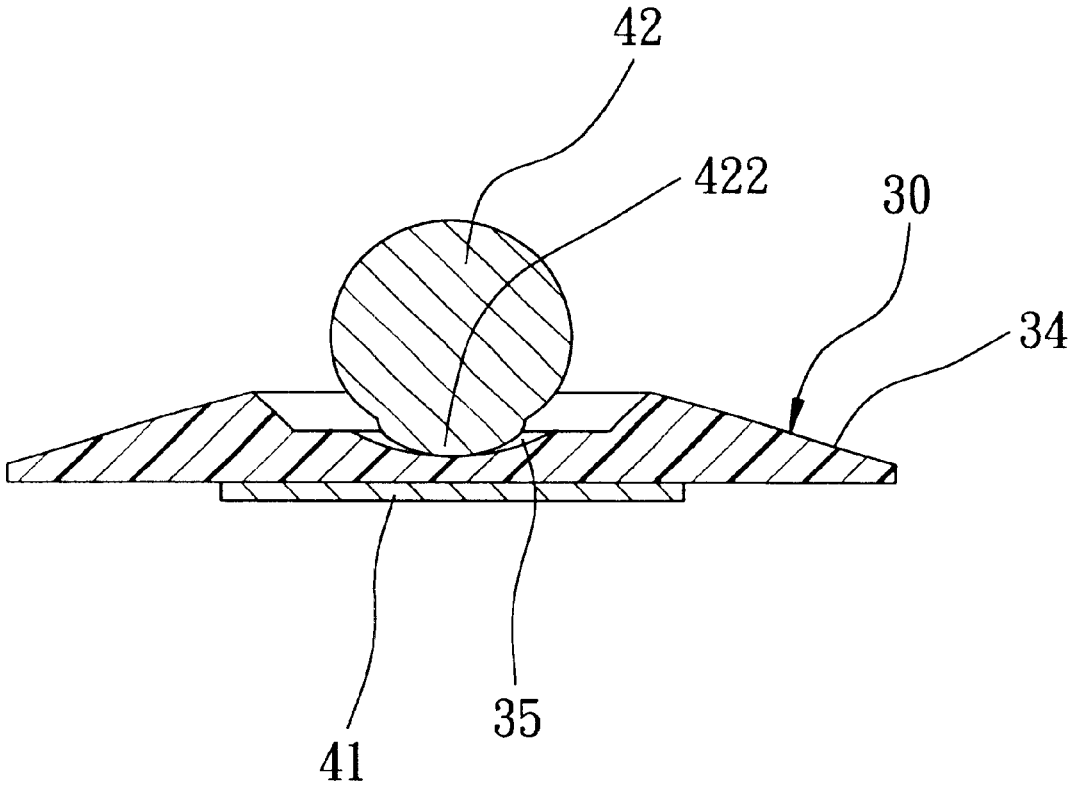
FIG. 6 is a sectional view of the first fastener and the second fastener of the first preferred embodiment.

With further reference to FIGS. 5 and 6, the first fastener 40 has a mounting section 41 mounted securely on the intermediate eyelet-free portion 132 of the second eyelet tab 13, and a fastener engaging section 42 provided on the mounting section 41.

The second fastener 30 has a shoe lace stringing section 31 formed with two eyelets 32, and a fastener engaging, section 33 extending from the shoe lace stringing section 31 and capable of removable engagement with the fastener engaging section 42 of the first fastener 40. The distance between the two eyelets 32 of the shoe lace stringing section 31 corresponds to the distance between two adjacent eyelets 121, 131 of the first or second eyelet tab 12 or 13.

The shoe lace unit 20 has a first portion 21 and a second portion 22. The first portion 21 of the shoe lace unit 20 is strung through the eyelets 121 of the first eyelet tab 12, the eyelets 131 of the second eyelet tab 13 and the eyelets 32 of the shoe lace stringing section 31 of the second fastener 30 to form a criss-cross pattern on the first and second eyelet tabs 12, 13. The second portion 22 of the shoe lace unit 20 is disposed proximate to the top opening 11, and can be tied into a knot for tightening the shoe.

As best shown in FIG. 5, the fastener engaging section 33 of the second fastener 30 includes a concave portion 35 and a guiding portion 34, which is disposed to surround the concave portion 35, and which has a proximate edge proximate to the concave portion 35, a distal edge distal from the concave portion 35, and an inclined surface that inclines downwardly from the proximate edge to the distal edge.

The fastener engaging section 42 of the first fastener 40 includes a resilient latch member 421 having a pivot end mounted pivotally on the mounting section 41, and a lock end opposite to the pivot end and formed with a convex protrusion 422 that projects toward the mounting section 41. When the second fastener 30 is disposed on the mounting section 41, the latch member 42 can be pivoted about the pivot end so as to enable the convex protrusion 422 on the lock end to move along the inclined surface and into the concave portion 35 to inter-engage the first and second fasteners 40, 30.

The mounting section 41 of the first fastener 40 further includes a barrier 43 which extends upwardly from a distal edge of the mounting section 41 and which is formed with a limiting flange 431 at a top edge of the barrier 43. The barrier 43 is disposed to abut against the shoe lace stringing section 31 of the second fastener 30 to restrict movement of the second fastener 30 relative to the first fastener 40.

Figure 8:
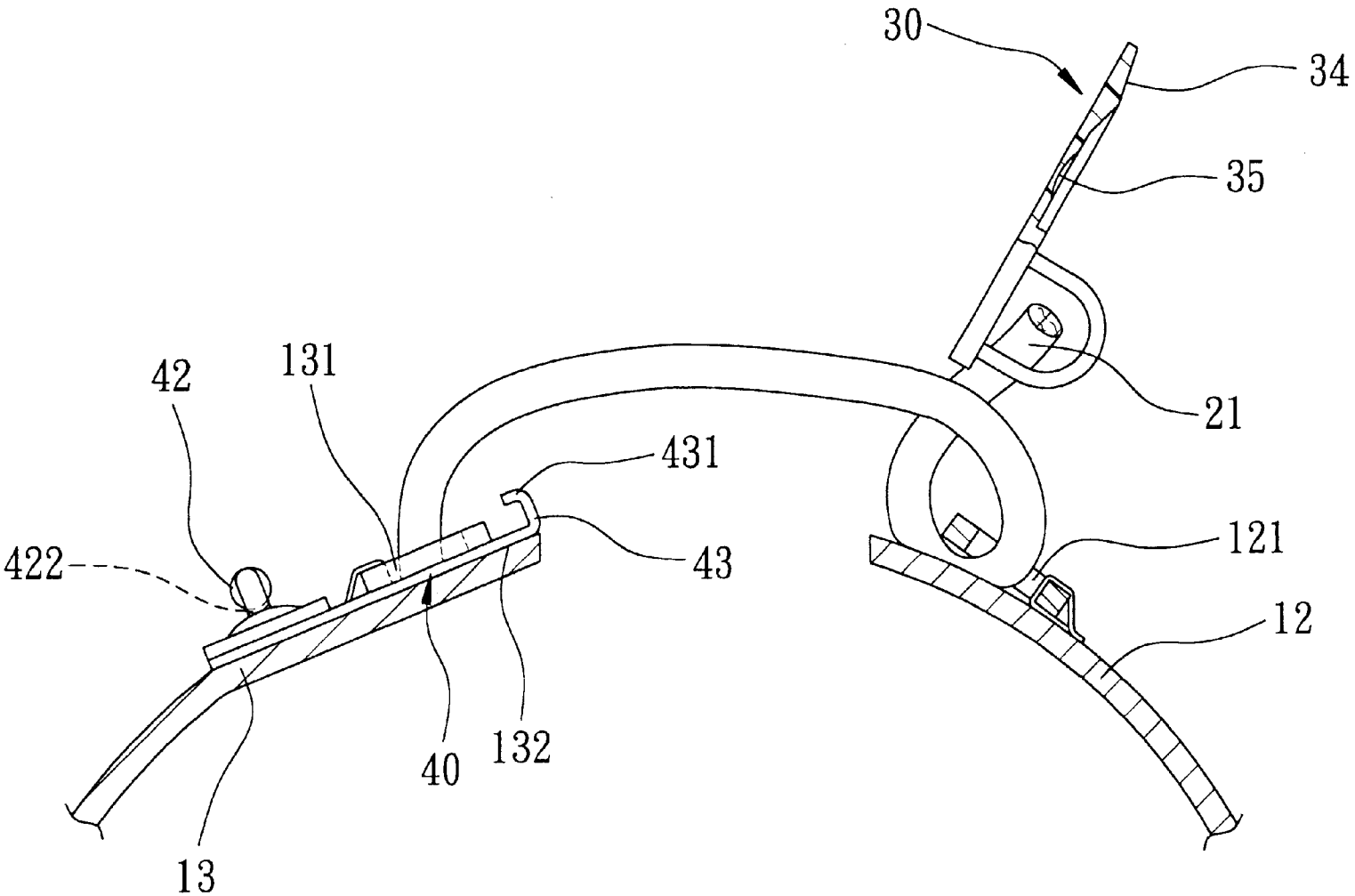
FIG. 8 is a fragmentary sectional view of the first preferred embodiment, showing the first and second fasteners in a disengaged state.
Figure 9:
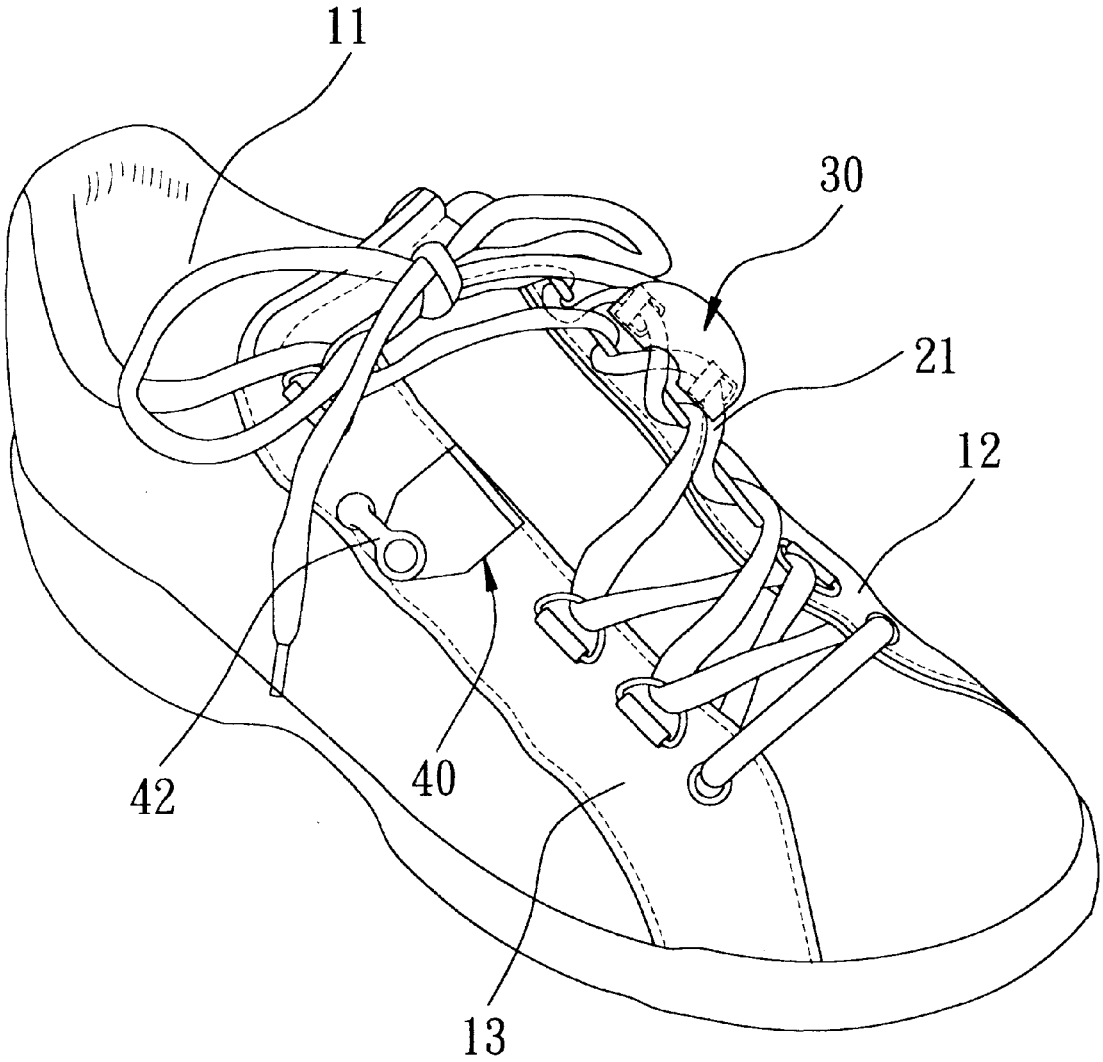
FIG. 9 is a perspective view of the first preferred embodiment of the shoe according to this invention, showing the first and second fasteners in the disengaged state.

Referring to FIGS. 8 and 9, when the wearer desires to take off the shoe, the resilient latch member 421 of the fastener engaging section 42 of the first fastener 40 can be pivoted about the pivot end thereof so as to disengage the convex protrusion 422 of the lock end of the resilient latch member 421 from the concave portion 35 of the fastener engaging section 33 of the second faster 30 for movement along the inclined surface of the guiding portion 34 of the fastener engaging section 33 of the second fastener 30. At this time, the second fastener 30 can be separated from the first fastener 40, and the first eyelet tab 12 and the second eyelet tab 13 can be loosened accordingly. Therefore, the shoe can be taken off quickly and easily.

Figure 10:
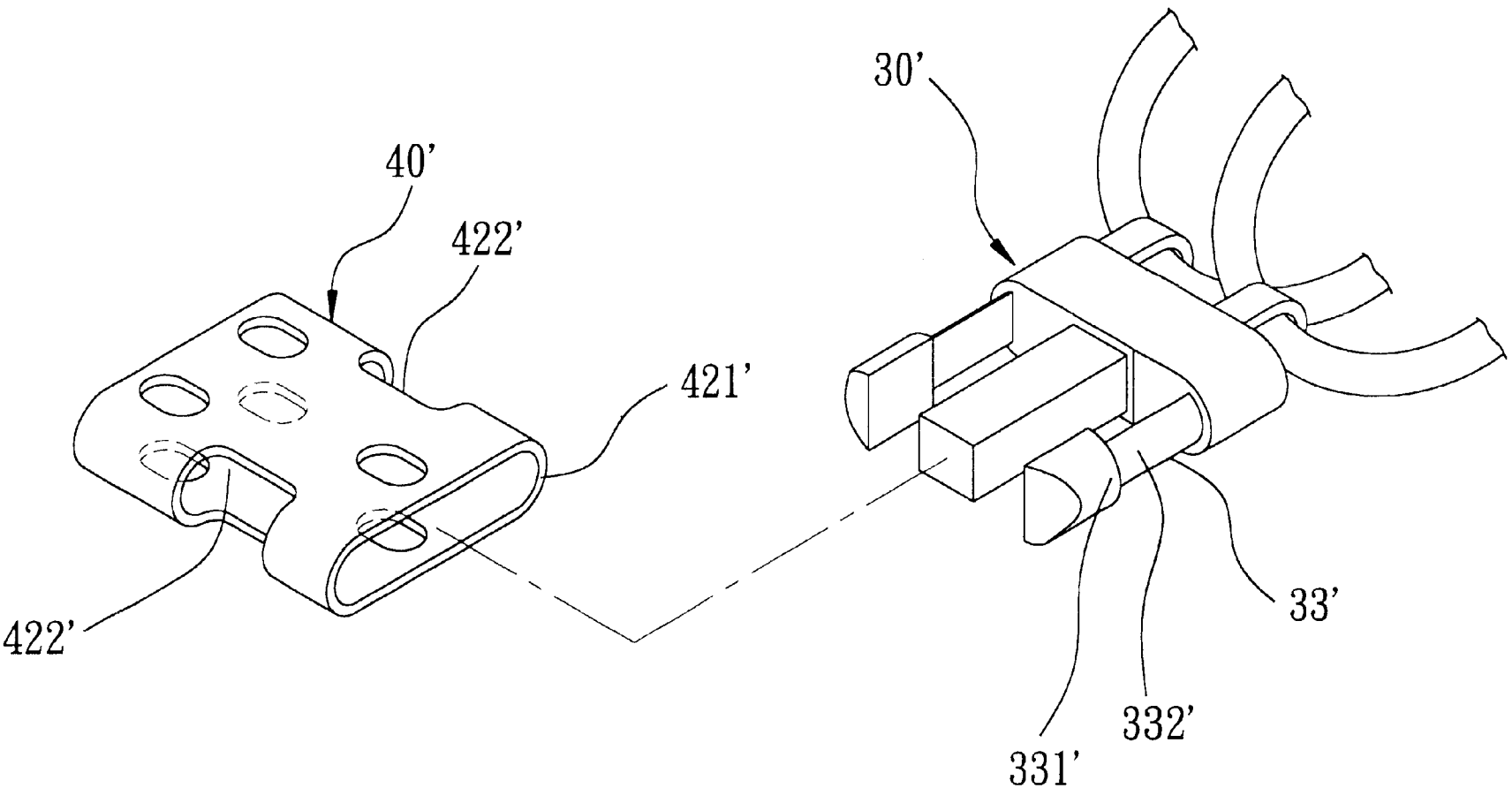
FIG. 10 is a perspective view showing first and second fasteners of the second preferred embodiment of a shoe according to this invention.
Figure 11:
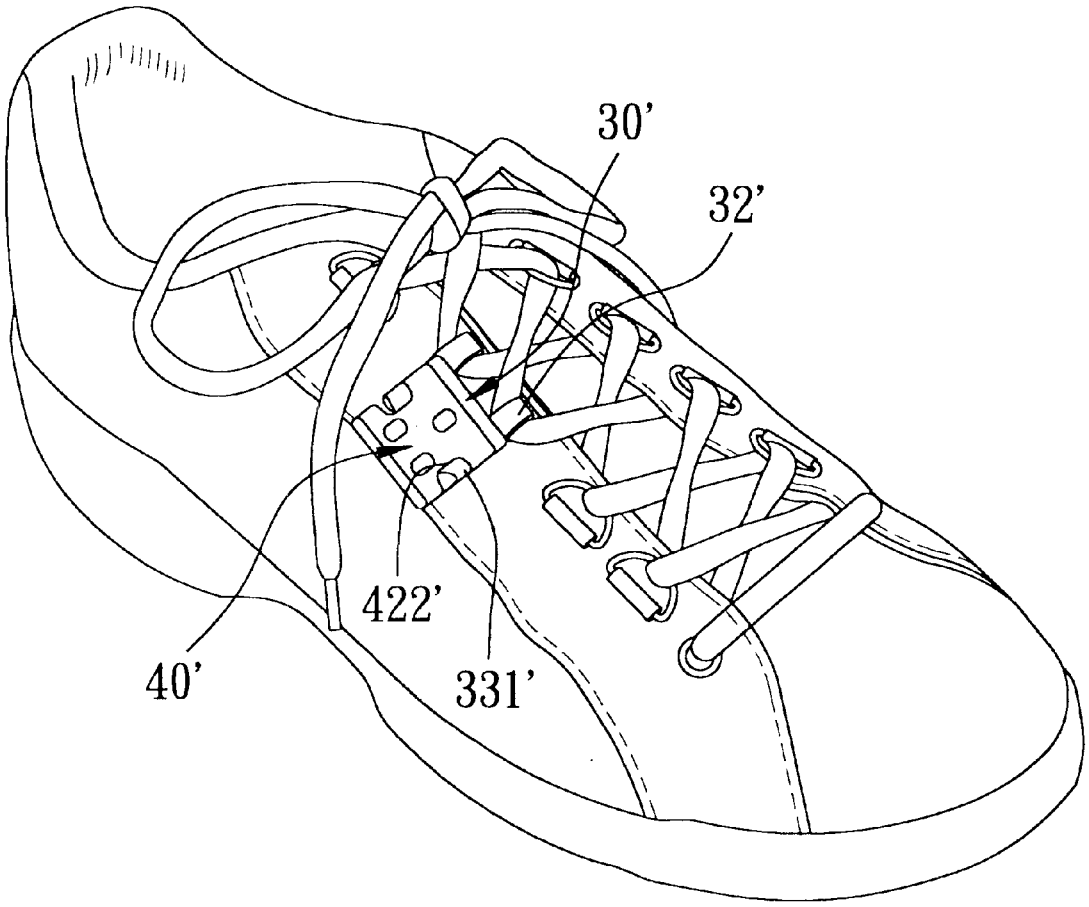
FIG. 11 is a perspective view of the second preferred embodiment of the shoe according to this invention.

FIGS. 10 and 11 illustrate first and second fasteners 40', 30' of the second preferred embodiment of a shoe according to this invention. As shown in FIG. 10, the mounting section and the fastener engaging section of the first fastener 40 cooperate to impart the first fastener 40' with a tubular configuration. The first fastener 40' has an open insert end 421' and is formed with radial fastener holes 422'. The fastener engaging section 33' of the second fastener 30' is formed with a resilient anchor member 332' that is inserted into the open insert end 421' and that is formed with hook ends 331' for engaging removably the fastener holes 421'.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A shoe, comprising:

a shoe body having a top opening, said shoe body including a vamp, a tongue, a first eyelet tab and a second eyelet tab, said tongue having a front portion connected to said vamp and a rear portion extending to said top opening, said tongue further having an opposite pair of lateral sides that extend from said vamp to said top opening, said first and second eyelet tabs being connected to said vamp and being respectively disposed adjacent to said lateral sides of said tongue, said first eyelet tab being formed with a plurality of eyelets, said second eyelet tab including a front portion proximate to said vamp, a rear portion proximate to said top opening, and an intermediate eyelet-free portion between said front and rear portions of said second eyelet tab, each of said front and rear portions of said second eyelet tab being provided with at least one eyelet;

a first fastener having a mounting section mounted securely on said intermediate eyelet-free portion of said second eyelet tab, and a fastener engaging section provided on said mounting section;

a second fastener having a shoe lace stringing section formed with at least one eyelet, and a fastener engaging section extending from said shoe lace stringing section and capable of removable engagement with said fastener engaging section of said first fastener; and a shoe lace unit having a first portion and a second portion, said first portion of said shoe lace unit being strung through said eyelets of said first eyelet tab, said eyelets of said second eyelet tab and said at least one eyelet of said shoe lace stringing section of said second fastener to form a criss-cross pattern on said first and second eyelet tabs, said second portion of said shoe lace unit being disposed proximate to said top opening.

2. The shoe as claimed in claim 1, wherein said fastener engaging section of said second fastener includes a concave portion and a guiding portion, which is disposed to surround said concave portion, and which has a proximate edge proximate to said concave portion, a distal edge distal from said concave portion, and an inclined surface that inclines downwardly from said proximate edge to said distal edge.

3. The shoe as claimed in claim 2, wherein said fastener engaging section of said first fastener includes a resilient latch member having a pivot end mounted pivotally on said mounting section, and a lock end opposite to said pivot end and formed with a convex protrusion that projects toward said mounting section, said latch member being pivotable about said pivot end so as to enable said convex protrusion on said lock end to move along said inclined surface and into said concave portion to inter engage said first and second fasteners when said second fastener is disposed on said mounting section.

4. The shoe as claimed in claim 1, wherein said mounting section of said first fastener includes a barrier which extends upwardly from a distal edge of said mounting section and which is formed with a limiting flange at a top edge of said barrier, said barrier being disposed to abut against said shoe lace stringing section of said second fastener to restrict movement of said second fastener relative to said first fastener.

5. The shoe as claimed in claim 1, wherein said mounting section and said fastener engaging section of said first fastener cooperate to impart said first fastener with a tubular configuration, said first fastener having an open insert end and being formed with a radial fastener hole, said fastener engaging section of said second fastener being formed with a resilient anchor member that is inserted into said open insert end and that is formed with a hook end for engaging removably said fastener hole.

* * * * *